United States Patent [19]

Golomb

[11] Patent Number: 4,953,874

[45] Date of Patent: Sep. 4, 1990

[54] EDUCATIONAL MARBLE BOARD GAME

[76] Inventor: Gary L. Golomb, 2021 E. Wood St., Tampa, Fla. 33604

[21] Appl. No.: 453,822

[22] Filed: Dec. 21, 1989

[51] Int. Cl.[5] ..... A63F 7/28

[52] U.S. Cl. ..... 273/355; 273/119 R; 273/120 R; 434/191; 434/327; 434/348

[58] Field of Search ..... 273/355, 356, 357, 242, 273/243, 118 R, 119 R, 120 R, 120 A; 434/191, 208, 327, 245, 348

[56] References Cited

U.S. PATENT DOCUMENTS

| | | | |
|---|---|---|---|
| 550,803 | 12/1895 | Post | 273/120 R |
| 657,522 | 9/1900 | Dieters et al. | 273/120 R |
| 2,753,187 | 7/1956 | Orsini | 273/120 R |
| 3,033,568 | 5/1962 | Acterberg | 273/355 |
| 4,036,497 | 7/1977 | Garto et al. | 273/357 |
| 4,061,334 | 12/1977 | Kanno | 273/120 A X |

FOREIGN PATENT DOCUMENTS

| | | | |
|---|---|---|---|
| 2191412 | 12/1987 | United Kingdom | 273/242 |

*Primary Examiner*—William H. Grieb
*Attorney, Agent, or Firm*—Charles A. McClure

[57] ABSTRACT

Educational marble board game for facilitating the teaching of arithmetic or other mathematical or related mainly numerical games. Marble launchers fitting upright near corners of a game board, outside a bounded generally horizontal playing surface, store marbles for use by the players. The players move player pieces along a pathway and receive instructions printed on the pathway segments. Released marbles are launched individually or together onto the playing surface, where they come to rest in respective indentations. Underneath each rest position is an answer to a question posed to the player, as by being keyed to the row and column in which the rest position indentation is located or alternatively printed directly on the playing surface alongside the marble rest position. Players are rewarded for correct answers, penalized for incorrect ones, or both, and optionally also by chance, with simulated money.

14 Claims, 3 Drawing Sheets

EDUCATIONAL MARBLE BOARD GAME

TECHNICAL FIELD

This invention relates to a marble board game, particularly one having a playing surface indented by marble rest positions wherein answers to questions are coverable by marbles in the rest positions.

BACKGROUND OF THE INVENTION

Many marble games are known in which a playing field is defined —if only by drawing a ring on the ground as in the traditional game wherein a player obtains each marble he can remove from the field by launching a marble onto it from outside the field. Some games have a board with a circumscribed playing field having a multiplicity of marble rest positions thereon, as in so-called Chinese checkers.

Locations on the board of a marble board game may have like values, or may have unlike values determined by their respective row and column intersection (or otherwise), or may have no value at all. Regardless, a marble game may be diverting but otherwise have little educational value. In my view, a game could as well provide both diversion and education simultaneously, and would be more worthwhile for so doing.

SUMMARY OF THE INVENTION

A primary object of the present invention is to provide players of it with both entertainment and education.

Another object of this invention is to teach players of this game something they would be less likely to learn—or to enjoy learning—in the absence of the game itself.

A further object of the invention is to educate the players in a subject not normally presented in the guise of a marble game.

Other objects of the present invention, together with means and methods for attaining the various objects, will be apparent from the following description and accompanying diagrams of preferred embodiments, which are presented by way of example rather than limitation.

Figure 6:
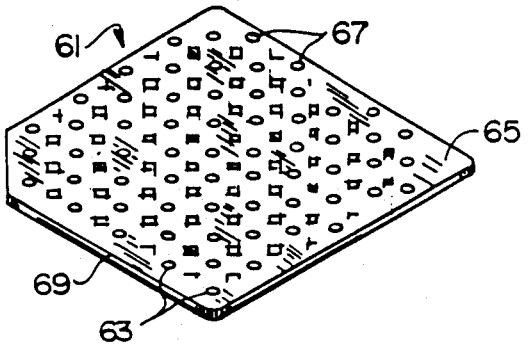

Fig, 5A is a perspective view of associated items of play;

Fig, 5B is a perspective view of other associated play items;

FIG. 6 is a perspective view of an alternate marble board; and

Figure 7:
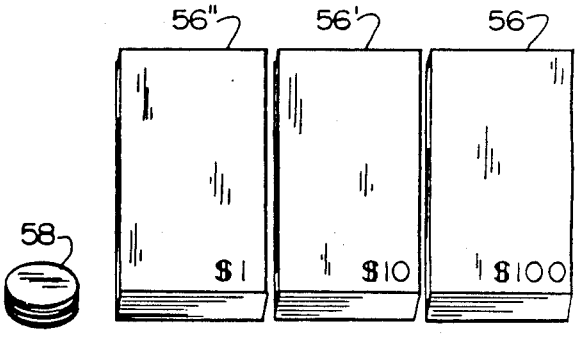
Figure 7:
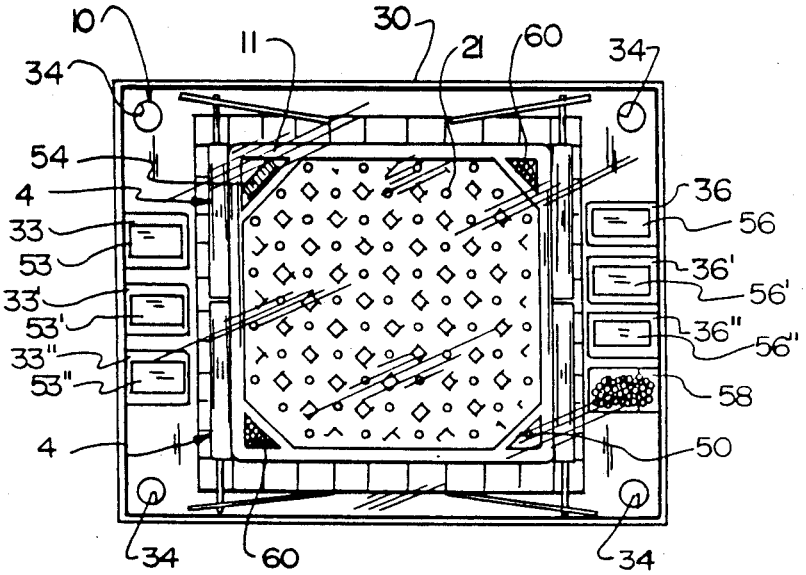

FIG. 7 is a plan view of an assembled game board and associated items of this invention in stowed arrangement, as stored or shipped.

DESCRIPTION OF THE INVENTION

Figure 1:
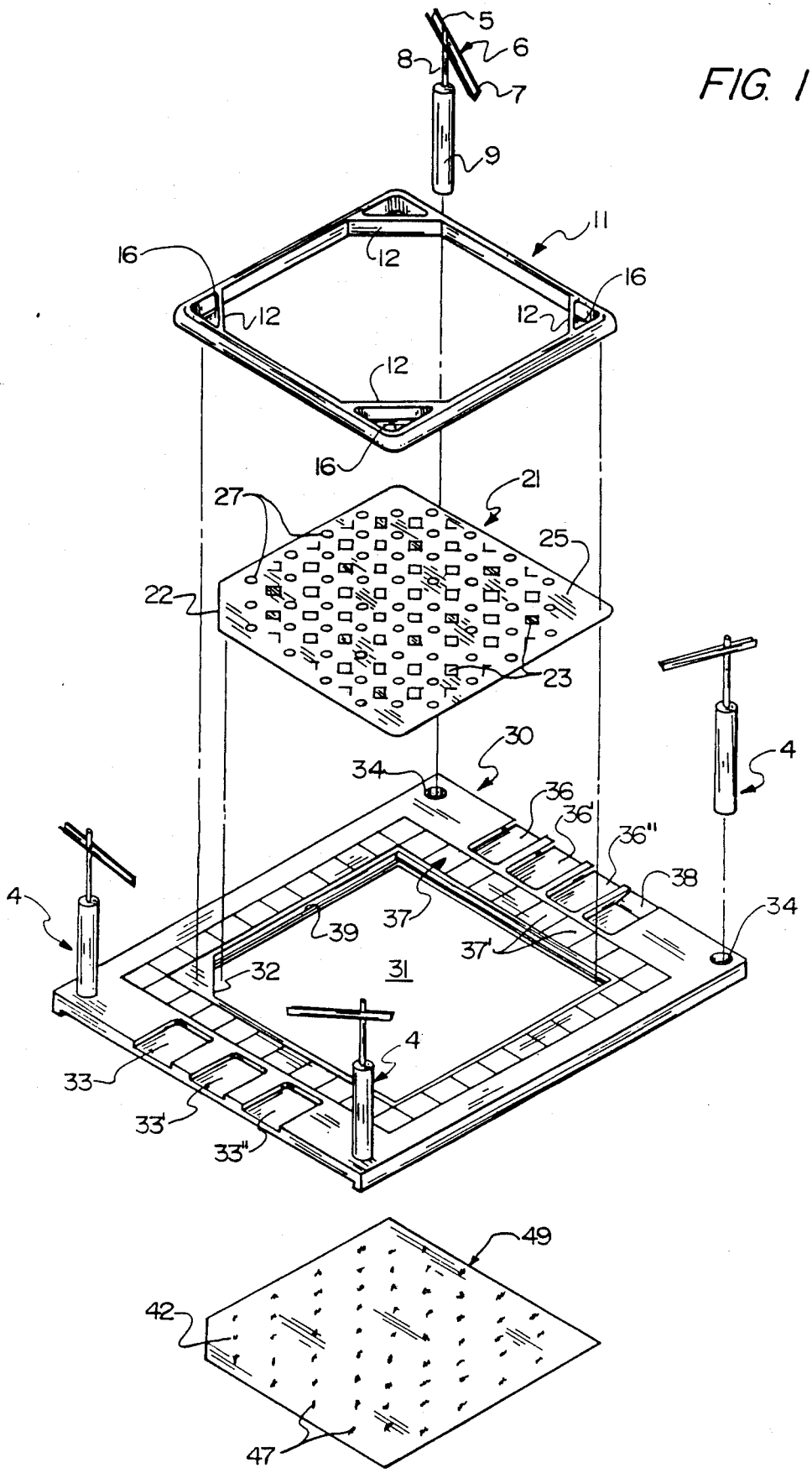
FIG. 1 is a partially vertically exploded perspective view of a game board and marble launchers according to the present invention.

FIG. 1 shows components of a game board according to this invention vertically exploded (as disassembled) for increased clarity, including marble launchers 4 upstanding in blind vertical bores 34 in the top surface of the corners of rectangular board holder 30.

Each marble launcher comprises an upstanding cylindrical body 9 with neck 8 of reduced diameter extending further upward a lesser distance thereabove. Inclined channel member 6 is intercepted by the neck and is thereby divided into upper storage track portion 5 and lower launching track portion 7.

From top to bottom, the game board components include barrier rack 11, marble board 21, board holder 30, and board underliner 49. The rack is square, with rounded corners plus diagonal corner braces 12 defining (with the corners) respective triangular wells 16. It will become apparent that the rack horizontally bounds the field of play and so functions as a barrier to retain therewithin marbles launched onto the field, which is constituted by the marble board.

Marble board 21 is square, with three rounded corners and its fourth corner 22 chamfered in alignment with a diagonal brace of the rack. The board has a multiplicity of marble-receiving indentations 27, as marble rest positions, arranged in rows and columns and joined by higher intervening surface 25 having a multiplicity of saddle-like portions 23, one between each pair of adjacent indentations. Each such indentation resembles an open-top cone and tapers to a diameter (open or closed) smaller than a given marble diameter.

Board holder 30 is rectangular and somewhat resembles an ornate picture frame, with stepped edge 39 bordering opening 31, in which marble board 21 fits. The opening is substantially square, but with one oblique corner 32 aligned with chamfered edge 22 of board 21. Square pathway 37 of successive individual segments 37' (marked with play messages) borders opening 31, including its oblique corner. A couple of marble launchers 4 are shown upstanding in corner bores 34. The left edge of the board (outside the bordering segmented pathway) has three rectangular recesses 33, 33' and 33" laterally spaced from one another and erupting to the exterior edge, each adapted to hold a small deck of cards. The opposite edge of the board has like rectangular recesses 36, 36' and 36" laterally spaced from one another and erupting to the edge, each adapted to hold a stack of paper money, and has also rather similar recess 38 with a lip inclined from the outer edge, being adapted thereby to hold coins.

Board underliner 49 is like marble board 21 in outline, having chamfered edge 42. The underliner bears a multiplicity of answer markings 47 aligned with respective marble indentations 27 (here openings) in the board. As such answers are preferably numerical in nature, little space is needed in which to represent them.

Figure 2:
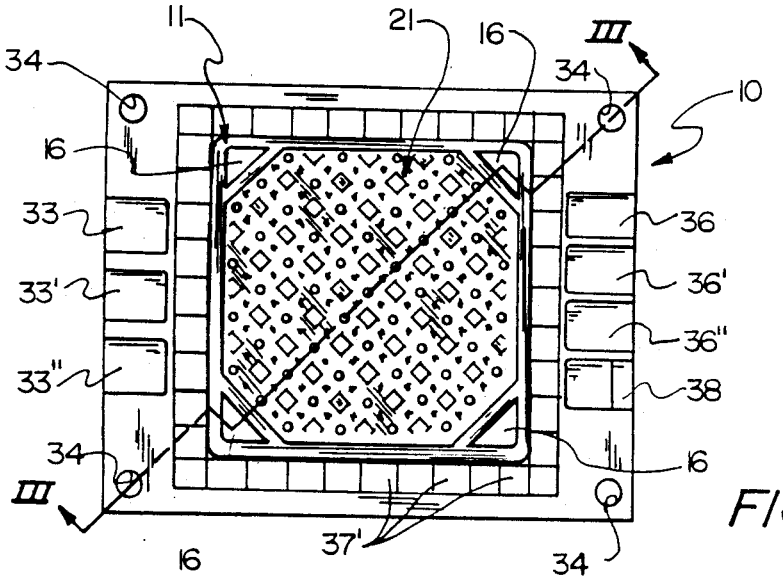
FIG. 2 is a plan view of the game board of the preceding view.

FIG. 2 shows assembled game board 10 of this invention, made up of the parts shown disassembled in the preceding view. Centermost is marble board 21, overlain along its perimeter by barrier rack 11, and both surrounded on all sides (in the plane of the view) by board holder 30. Crossing FIG. 2 in a generally diagonal direction from the lower left to the upper right is sight line III—III along which the next view is taken in the direction of the end arrows.

Figure 3:
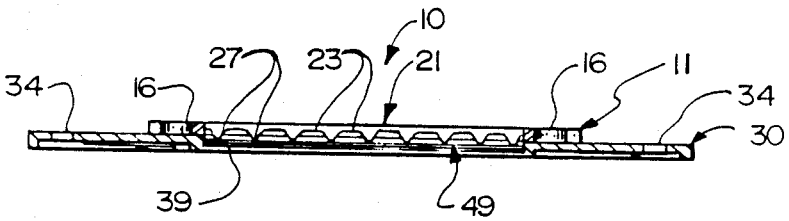
FIG. 3 is a sectional elevation taken at III—III on FIG. 2.

FIG. 3, taken on FIG. 2 as just noted, shows assembled game board 10 in sectional elevation, featuring board holder 30 supporting on its stepped edge 39 both underliner 49 and overlying marble board 21. The top surface of the board holder supports barrier rack 11 surrounding the marble board.

Figure 4A:
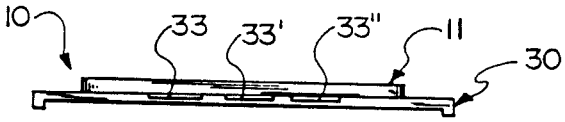
FIG. 4A is a left side elevation of the preceding game board.
Figure 4B:
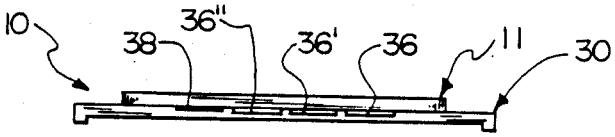
FIG. 4B is a right side elevation of the same game board.

FIGS. 4A and 4B show assembled game board in elevation from the left and right sides, respectively. In both views, board holder 30 and overlying barrier rack 11 hide the marble board from view. In FIG. 4A, card recesses 33, 33,, and 33'' are visible from left to right in the near edge of the board holder. In FIG. 4B, the near edge of the board holder shows—as the bank—from right to left: bill-holding recesses 36, 36', and 36'', also coin-holding recess 38.

Figure 5A:
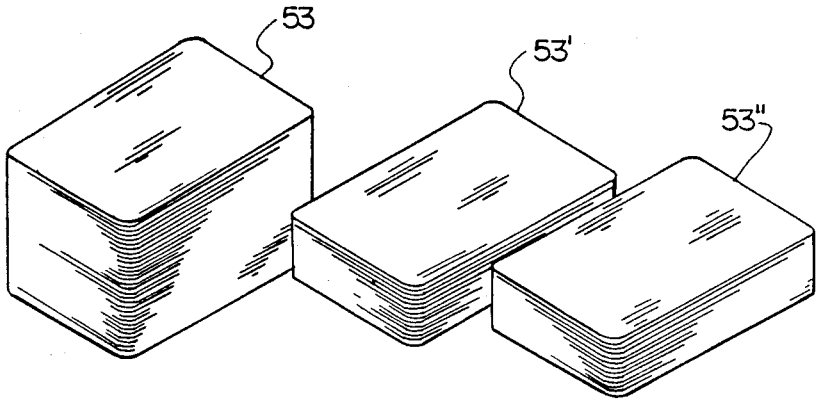
Figure 5B:
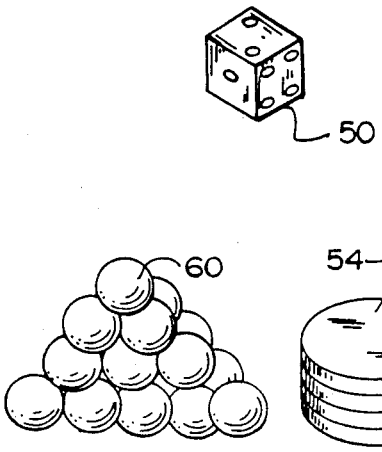

FIGS. 5A and 5B show, in perspective and on an enlarged scale, associated items useful in the playing of games based upon game board 10. FIG. 5A shows question cards 53, misfortune cards 53', and good fortune cards 53''—which are located in respective recesses 33, 33', and 33'' during play. FIG. 5B shows die 50, marbles 60, player pieces 54, simulated bills 56 ($100), 56' ($10), and 56'' ($1) —placed in respective recesses 36, 36', 36'' during play—and coins 58 (e.g., dimes) similarly placed in recess 38 during play.

FIG. 6 shows, in perspective, alternative marble board 61, with open-top conical marble indentations 67 in top surface 65, which has saddle-like portions 63 between each pair of adjacent indentations. Unlike previous marble board 21, marble board 61 has underliner 69 integrally formed or attached by suitable fasteners. Answers may be on the underliner or within the base of closed conical indentations.

FIG. 7 shows in plan game board 10, including barrier rack 11, marble board 21, and board holder 30—upon which are stowed all the associated items: cards 53, 53', 53'' in recesses 33, 33', 33'', and money 56, 56', 56'', 58 in recesses 36, 36', 36'', 38; marble launchers 4, lying just outside rack 11; and—within the rack—die 50, player pieces 54, and marbles 60 arranged in the triangular wells. Not shown is a set of instructions for one or more games, which may be in a pamphlet or on the inside cover of a box for the game, or even printed on the board support itself.

Use of the game board and associated items of this invention to play an arithmetic game will be readily understood from the foregoing description, with reference to the various Figures, as follows.

In setting up to play the game, each player selects a marble launcher and sets it upright with its base in the corner recess on the player's right. Each player selects a colored player piece and takes the prescribed number of marbles of that color (e.g., 5 or 6) and places them on the upper or storage portion of the launcher's track. The player on the "bank" side of the game board places the simulated bills and coins in the appropriate recesses and also gives each player a given initial amount of simulated money. The player on the opposite side of the board places the respective card decks in their appropriate recesses.

One of the pathway segments is marked START HERE. The players each roll the die once, and the highest scored goes first. In the event of a tie, the tying players roll further to break the tie(s). The starting player rolls the die and moves his or her player piece the corresponding one to six segments clockwise (to the player's left) from the starting segment. Upon reaching any segment a player reads the instructional message on that segment and does whatever it requires—which may necessitate one or more other players doing something in addition or instead of the first player.

A frequent instruction on the pathway is for a player to roll one or more marbles and to answer the question(s) posed on the 22 marble field adjacent to the particular marble indentation(s) in which the marble(s) come to rest—or optionally keyed, as by indentation row and column number to a separate printed question list.

The players have the same number of marbles apiece, about enough to fill the upper tracks of their respective launchers. If instructed to launch one or more marbles, a player manually turns the launcher to aim in the desired azimuthal direction, transfers the marble(s) to the lower or launching track (individually or together), and releases the same to roll onto the playing field. Each marble will come to rest in an indentation, whereupon the player may be obligated to read and answer one or more questions.

After answering, the player lifts each marble and reads the answer covered thereby. The player gets a reward (usually money, perhaps another turn, etc.) if the answer is correct, or suffers a penalty if the answer is incorrect, as stated in the previous instruction or otherwise according to the rules. The marbles are then replaced into the upper or storage track of the player's launcher.

An alternative instruction is to draw a card, which may be a question card with a stated reward for the right answer and penalty for the wrong answer, or may be a misfortune card (lose money, turn, etc.) or a good fortune card (win money, another turn, etc.). Diverse rules and/or instructions may accompany otherwise identical physical board components for similar use, except as modified by the reward or penalty messages or the rules or instructions themselves.

The end of the game may be determined by time, total number of turns, players losing (or winning) the initially allocated money, etc. In any event the player with the most money at the end of the game wins. Of course, everyone answering questions is likely to improve at arithmetic (or other subject matter) in striving to win.

This invention does not require any unusual materials or method of fabrication. The game board components can be pressed or molded metal, plastic, wood fiber, or the like. The segmental path messages and the playing field questions and underlying answers can be molded therein or printed directly thereon or on labels adhesively applied thereto. The marble launchers can be made of like material The cards, die, marbles, money, and players' pieces are conventional constituents of many games. Everything can be packaged in a box of the type commonly used for board games.

This game is especially suited to arithmetical or other mathematical questions because the answers are short, usually expressed as a relatively short number or other set of numerals, so a marble of modest size can cover such an answer satisfactorily. Of course, other types of questions may be substituted for arithmetical ones, such as algebraic, geometric, or trigonometric. It will be apparent that locating answers on a separate underlying layer enables more than one overlying question layer to be used with the same answers, as 4 may be the answer to $2+2$, $2\times2$, $20\div5$, etc. Other relatively quantitative subjects also are suitable because of their usually short and often numerical answers, such as aeronautical, astronomical, chemical, geographic, meteorological, oceanographic, etc.

Only the playing surface and underliner need be changed to convert to a different subject or at least a different set of questions and answers. Where the answer underliner is integral with or fastened to the playing surface—or where the answers are printed in closed conical or similar indentations—board interchangeability or game convertibility is further simplified to preclude getting wrong combinations of questions and answers.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

I claim:

1. Marble board game comprising a game board and accessories, the game board including a playing field indented by rest positions for marbles launched onto the playing field, wherein the surface of the playing field between marble rest positions is higher than the marble rest positions and is generally uneven, and marble rest positions contain therein answers to questions and have associated therewith questions to which such answers are the correct answers displayed on the board adjacent respective marble rest positions containing their correct answers;

the accessories including marbles launchable onto the playing field to occupy such rest positions, and means for so launching the marbles.

2. In a marble board game including a game board with a playing field having indented marble rest positions, the improvement wherein the surface of the playing field between marble rest positions is higher than the marble rest positions and is generally uneven, and wherein marbles in rest positions cover answers to questions located therein.

3. Improved marble board game playing field according to claim 2, wherein the given questions are displayed on the playing field in the vicinity of the respective marble-covered answers.

4. Marble board game with game board according to claim 2, surrounded laterally by a board holder.

5. Marble board game with game board according to claim 2, in integral form, wherein the respective rest openings have conical bases on whose upper surface the respective answers are carried.

6. Marble board game with game board according to claim 2, in inseparable layered form, wherein an upper layer has openings therein bounding the marble rest positions, and a lower layer underlies the upper layer and carries the answers thereon under the rest position openings.

7. Marble board game with game board according to claim 2, in separable layered form, wherein an upper layer has openings therein bounding the marble reset positions, and a removable lower layer underlies the upper layer and carries the answers thereon under the rest position openings.

8. Method of playing a marble board game having a board with a playing field indented at intervals of marble rest positions, comprising the steps of launching marbles sequentially onto the playing field, whereupon each marble comes to rest in an indented rest position, each such rest position containing the answer to a question associated only with that particular rest position, whereby the marble in a rest position covers such answers;

undertaking to answer such question, then retrieving the marble to reveal the answer covered by the marble in the rest position; and taking given action in the event of having answered the question correctly, and taking other given action in the event of having answered the question incorrectly.

9. Marble board game playing method according to claim 8, wherein the marbles are launched from an aimable device at a given location on the board, including the step of aiming a marble toward a preferred part of the playing field.

10. Marble board game playing method according to claim 8, wherein the game board includes a pathway to be traversed by player tokens and bearing directions for players to take certain actions.

11. Marble board game playing method according to claim 8, wherein the questions and answers are mathematical, including the step of obtaining or relinquishing money tokens dependent upon the correctness or incorrectness of answers.

12. In playing marble board games, the combination of steps of selecting a question by launching a marble onto a playing field having numerous marble rest positions, each rest position presenting a question and the answer thereto, the question being visible but the answer being covered by a marble occupying such rest position;

selecting a prospective answer for the question presented at an occupied rest position, removing the marble covering the answer, and comparing the tentative answer to the revealed answer; and taking whatever action the outcome of the comparison requires.

13. Marble board game including a game board having marble rest positions and comprising an uneven surface at an elevated level, a lower surface underlying the foregoing surface and providing marble rest positions carrying answers to collocated questions, and therebetween an intermediate surface with marble-sized openings therein admitting marbles thereinto above marble rest positions.

14. Marble board game with game board according to claim 13, and accessories including cards carrying questions collocated with the answers carried at rest positions of the lower surface.

* * * * *